United States Patent [19]

Hershberger

[11] Patent Number: 4,485,375

[45] Date of Patent: Nov. 27, 1984

[54] GRIP-RESPONSIVE DOZING DRIVER ALARM

[76] Inventor: Vilas D. Hershberger, R.R. #1, Hesston, Kans. 67062

[21] Appl. No.: 426,683

[22] Filed: Sep. 29, 1982

[51] Int. Cl.[3] ..... G08B 21/00

[52] U.S. Cl. ..... 340/576; 180/272; 340/575

[58] Field of Search ..... 340/575, 576, 573, 52 R, 340/52 D, 53; 180/272; 200/61.54, 61.56, 61.57, 61.38, 61.36

[56] References Cited

U.S. PATENT DOCUMENTS

| | | | |
|---|---|---|---|
| 2,568,482 | 9/1951 | Blomberg | 180/272 |
| 3,026,503 | 3/1962 | Scheer | 180/272 |
| 3,049,090 | 8/1962 | Bergen | 116/67 R |
| 3,965,320 | 6/1976 | Ditzig | 200/314 |
| 4,219,800 | 8/1980 | LeViness | 340/52 D |

*Primary Examiner*—Glen R. Swann, III

*Attorney, Agent, or Firm*—Kokjer, Kircher, Bradley, Wharton, Bowman & Johnson

[57] ABSTRACT

An alarm system for signaling incapacity of a vehicle driver to sustain a safe level of attention to his driving as may be occasioned by want of sleep or the influence of alcohol or drugs, with such system including an electric enabling switch in series with the ignition switch and the battery. A normally closed push button alarm switch is mounted on the steering wheel whereby a driver's hand can concurrently grip the steering wheel and depress the button to keep the alarm switch open. The alarm switch is in series with the other switches as well as with an alarm signaling device so that an alarm is given when the driver's grip on the steering wheel is relaxed. Another signal device is connected in series with the battery and the ignition and enabling switches whereby passengers may be assured that the alarm system is energized and has not been disabled by an overconfident driver.

4 Claims, 9 Drawing Figures

FIG. 1
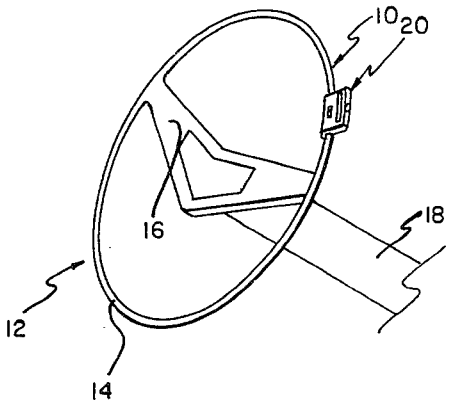
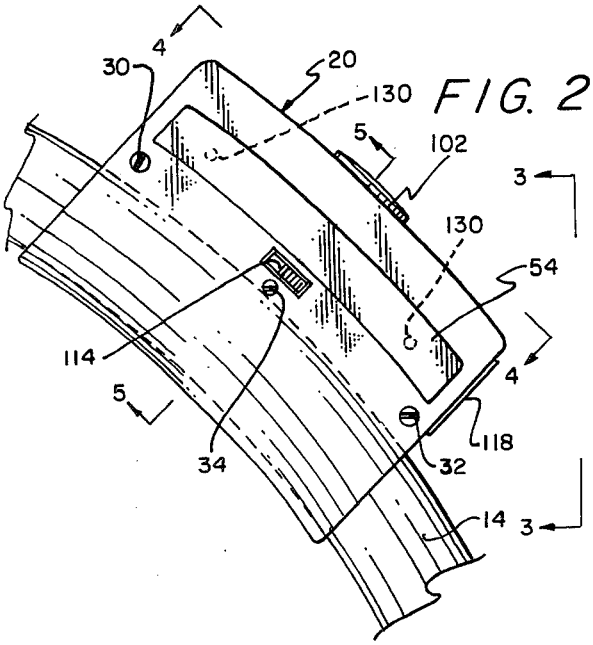
FIG. 2
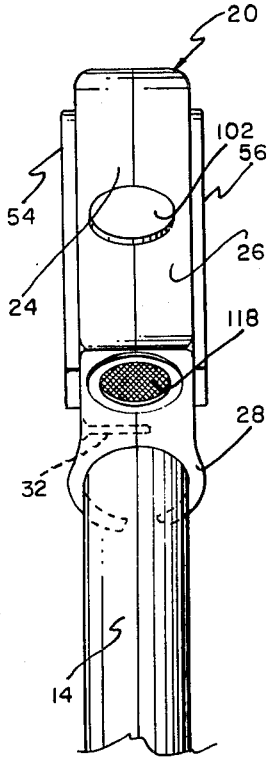
FIG. 3
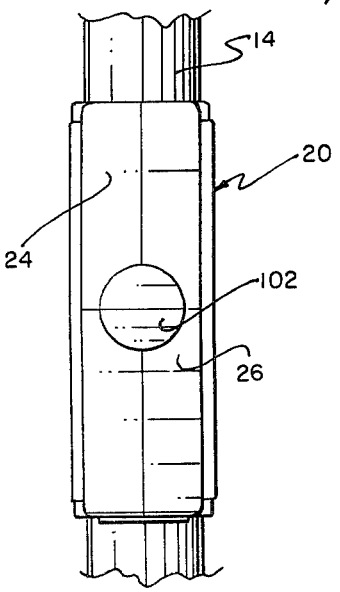
FIG. 4

GRIP-RESPONSIVE DOZING DRIVER ALARM

BACKGROUND OF THE INVENTION

The present invention pertains to an alarm for alerting a vehicle driver as well as his passengers to the fact that the driver is dozing or incapable of devoting continuous attention to his driving, and more particularly pertains to the generation of attention commanding visual and/or audible signals upon the driver failing to maintain a firm grip upon the steering wheel.

The menace of vehicle drivers, dulled by want of sleep or under the influence of drugs or alcohol, to themselves, their passengers, other motorists, and pedestrians need not be dwelt upon as the public is frequently apprised of the grisly statistics pertaining to the deaths and serious injuries resulting therefrom. Also of great importance is the mental anguish and loss of support suffered by friends and relatives of the victims of the incapacitated or what might be termed the "dozing driver". Of lesser importance but nonetheless great importance is the property loss pertaining to automobiles as well as to roadside property and structures.

Dozing drivers and/or his passengers are often unaware of the driver being incapacitated insofar as the driver being able to maintain a reasonably safe degree of attentiveness to his driving.

SUMMARY OF THE INVENTION

The paramount objective of the present invention is to provide a means whereby a driver can be apprised at any moment that he loses his ability to maintain a condition that reflects his attentiveness.

Another important objective in accordance with the preceding objective is to provide such means that are directly related to the driving function such as the maintenance of a firm grip on the steering wheel.

Still another important objective in accordance to the preceding objectives is to provide means that will inform the passengers of the driver's incapacity, with such means preferably also being such as to enable passengers to ascertain if the driver has succumbed to any temptation (based on an unwarranted estimate of his driving ability) to disable the alarm system.

Another object is to provide a simple, inexpensive and reliable means for attaining the objectives given above.

A final objective to be specifically mentioned is to provide the desired means in a form that can be made available as an attachment for extant vehicles, as well as in a form that can be incorporated as an integral component of vehicles to be manufactured in the future.

Broadly, the alarm system of the invention comprises a normally closed electric switch mounted on and operatively associated with the steering wheel in such a manner that the switch is opened only while the steering wheel is gripped by the driver for attentive steering, and electric circuit means inclusive of a signal means operative on closure of the switch to warn of inattention of the driver. In a more limited aspect, means are provided for signaling to passengers that the alarm system is electrically energized for operation.

BRIEF DESCRIPTION OF THE DRAWING

These and other objectives and features will become evident during the following description of preferred embodiments of the invention, such description being given in conjunction with the accompanying drawings, wherein:

FIG. 1 is an isometric view of a conventional steering wheel and broken steering column, and shows the alarm switch and signaling system of the invention mounted as an attachment upon the steering wheel to constitute a handgrip for the steering wheel rim;

FIG. 2 is a plan view on an enlarged scale of the attachment of FIG. 1, with only a broken portion of the steering wheel rim being shown;

FIG. 3 is an elevational view of the structure shown in FIG. 2, the view being taken from the plane of the line 3—3 in FIG. 2, with hidden details being shown in dashed outline;

FIG. 4 is an elevational view of the structure shown in FIG. 2, the view being taken from the plane of the line 4—4 in FIG. 2, with hidden details being shown in dashed outline;

DESCRIPTION OF THE PREFERRED EMBODIMENTS

Figure 5:
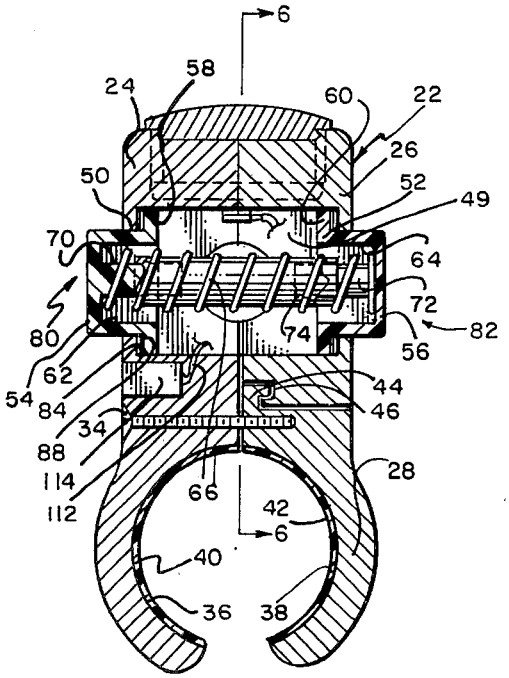
FIG. 5 is a sectional view taken upon the plane of the section line 5—5 in FIG. 2, with the steering wheel rim being deleted.

Referring now to the drawings wherein like numerals designate like parts throughout the various views and directing attention initially to the form of the invention shown in FIGS. 1–8, the reference numeral 10 designates generally the combination of a steering wheel equipped with a dozer alarm system. The combination 10 comprises a conventional steering wheel 12 that includes a circular rim 14 mounted on a hub and spoke structure 16 that is in turn rotatively mounted in a conventional manner upon a steering column partially shown in FIG. 1 at 18.

The dozer alarm system of the combination 10 comprises an attachment designated generally at 20 that is detachably mounted on the steering wheel rim 14. While the attachment 20 can be mounted at any desired position about the periphery of the rim 14, the same should be mounted at a position thereabout that is normally gripped and should be gripped by a hand of an attentive driver. The attachment 20 is shown in FIG. 1 at good location for a right-handed driver, namely, at about the two-o'clock position as viewed by the driver. The location chosen is not critical and can be selected to suit the preference and normal driving posture of the driver when he is fully in possession of all his faculties, and needless to say not under the influence of alcohol or drugs or in urgent need for rest or sleep.

As shown in FIG. 5, the body 22 of the attachment 20 is of three-piece construction and includes front and rear parts 24 and 26 and a rear clamp section 28. The body 22 can be metallic such as of cast and machined aluminum or die cast of zinc, or be of a suitably tough plastic. In assembled form, as shown best in FIGS. 2, 5 and 6, the body parts 24 and 26 are secured together by screws 30 and 32 that extend through the body part 24 and thread securely into the body part 26. In assembled form the lower rear clamp portion 28 is secured in position by a screw 34 that extends through the front body of part 24 and which is securely threaded into the body clamp part 28.

It will be noted that, in assembled form, the body 22 defines a split or C-type clamp constituted of the lower rear face 36 of the front part 24 being concave and contoured to conform to or fit the wheel rim 14. Similarly, the front face 38 of the clamp 28 is correspondingly contoured so that the wheel rim 14 can be clamped therebetween. Preferably, and as shown, the faces 36 and 38 are coated at 40 and 42 with silicone rubber or the like to enhance a nonslipping engagement with the steering wheel rim clamped therebetween.

In order to assure proper alignment of the clamping portion 28 with the outer parts 24 and 26 of the body 22, a longitudinally central portion of the upper edge of the clamp 28 is provided with an upstanding L-shaped flange 44 (FIG. 5) that is accommodated in a mating groove 46 in the rear body portion 26. The arrangement is such that after the body parts 24 and 26 are secured together and appropriately oriented relative to the steering wheel rim 14, the flange 44 is worked into the groove 46 on turning the clamp 28 clockwise as viewed in FIG. 5 to seat the deformable and resilient coating 38 against the wheel rim 14 in opposition to the face 36 and its coating 40. The screw 34 is then inserted and tightened to obtain an adequate clamping force for the attachment 20 upon the steering wheel rim 14.

The body 22 has a hollow interior 49 with elongated windows 50 and 52 opening through the parts 24 and 26 thereof. Elongated push buttons 54 and 56 of electrically insulative material are positioned in such windows 50 and 52. The push buttons are of transparent or translucent material such as any suitable synthetic resin or plastic and are movable inwardly and outwardly in the windows with outward movement being limited by peripheral flanges 58 and 60 respectively.

Figure 7:
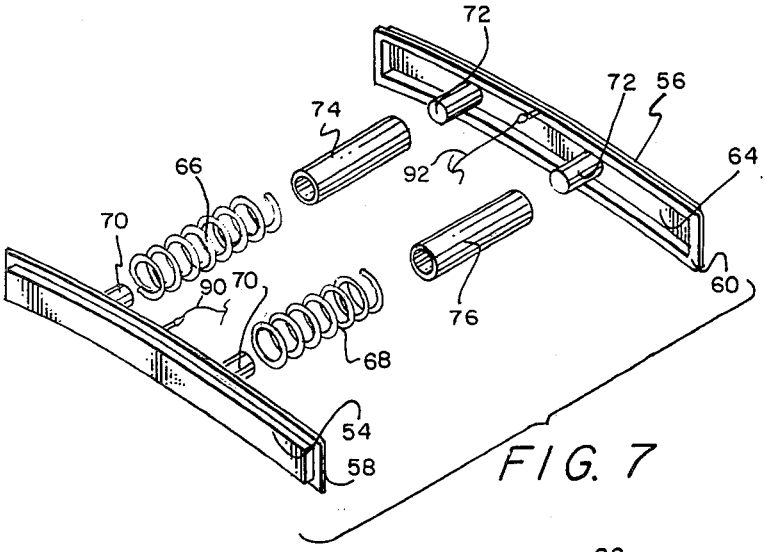
FIG. 7 is an exploded isometric view of the alarm switch push button structure.

As clearly shown in FIG. 5 the opposed sides of the push buttons 54 and 56 are provided with elongated recesses as indicated at 62 and 64 with means being provided to yieldingly urge the push buttons 54 and 56 apart. The last means comprises, as shown in FIGS. 5 and 7, a pair of coiled compression springs 66 and 68 disposed to have their opposite ends received in the recesses 62 and 64 bear against the push buttons 54 and 56.

The springs 66 and 68 are retained in position by the provision of the push buttons 54 and 56 being provided in integral pairs of opposed cylindrical bosses 70 and 72 that are received within and embraced by the opposite ends of the springs 66 and 68. Proper alignment of the springs 66 and 68 is further enhanced by guide sleeves or rods 74 and 76 respectively received within the springs 66 and 68 between the bosses 70 and 72. The sleeves are of a length that will not prevent both of the push buttons 54 and 56 being fully depressed at the same time.

Figure 8:
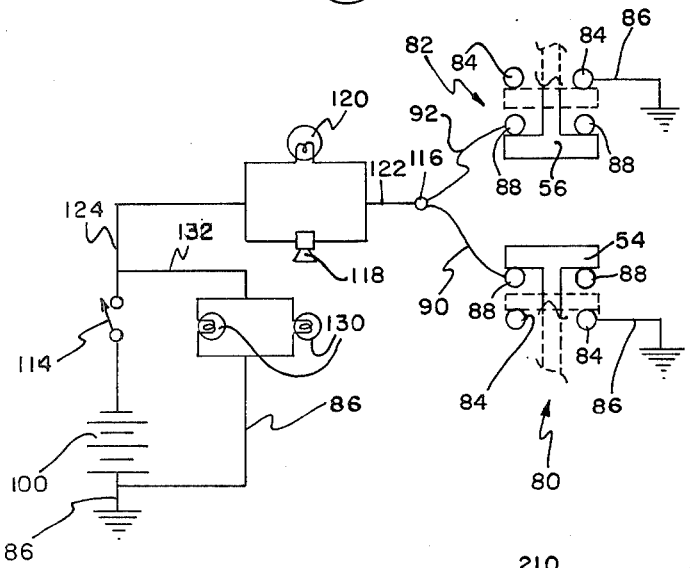
FIG. 8 is an electrical schematic view of the alarm signaling system.

The push buttons 54 and 56 are components of normally closed push button switches indicated at 80 and 82 in the schematic drawings in FIG. 8, wherein the push buttons are shown in their normal switch closing positions in dashed lines and in full lines in their depressed switch opening positions.

The switches 80 and 82 are identical and a detailed description of one will suffice for both. The switch 80 comprises a fixed contact 84 which can simply be the internal surface of the body part 24 surrounding the window 50 when the body 22 is metallic and thereby constitute an electrical circuit ground 86 as shown and as is preferred. The movable contact 88 of the switch 80 is a peripheral metal lining fixed to the flange 58 of the insulative push button 54. A flexible insulated conductor 90, partially shown in FIG. 7, is connected to the contact 88, and a corresponding, partially shown, conductor 92 is connected to the switch 82. The connections of the conductors will be made clear in connection with a description of FIG. 8.

The composite body 22 is provided with a socket or pocket 94 (FIG. 6) within which an electric battery 100 is received, the same being removably retained therein by a cover 102 that is threaded into the body 22. The battery 100 is of the type that is commonly used in camera equipment and the like. The case or shell of the battery 104 is one terminal thereof and contacts the body 22 of system ground 86. The inner end 106 constitutes the other battery terminal and contacts a contactor 108 that is secured to the body 22 at 110 in electrical isolation therefrom by conventional means. The contactor 108 is connected by an insulated conductor 112 to a conventional electrical slide switch 114 that is recessed in the body part 24 as clearly shown in FIGS. 2 and 5.

FIG. 8 shows the flexible conductors 90 and 92 to be connected at 116, with an electric buzzer or sounder 118 and an incandescent lamp 120 being connected in parallel between the juncture 116 and the switch 114 by leads 122 and 124. The sounder 118 and the lamp 120 are connected as shown in FIG. 8 in parallel between the leads 122 and 124.

A pair of low wattage incandescent lamps 130 which may be "wheat grain" size are connected in electrical parallel between the lead 124 and the ground 86 by a circuit inclusive of a lead 132 in an arrangement that the lamps 130 are energized whenever the enabling or slide switch 114 is closed or on. The lamps 130 are suitably mounted by means not shown in the cavity or body hollow 49 so as to emit a glow visible through the push buttons 54 and 56. It is preferred that the push buttons 54 and 56 be translucent or of light diffusing character so that they glow in a manner that is visible from a wide angle. Such lamps 130 serve not only as battery condition indicators but also as indicators that the alarm system is on, a fact of great significance to passengers. It will be understood that the push buttons 54 and 56 are of sufficient length that some glowing portion will be visible despite the attachment 20 being gripped in the hand as will be presently explained.

Figure 6:
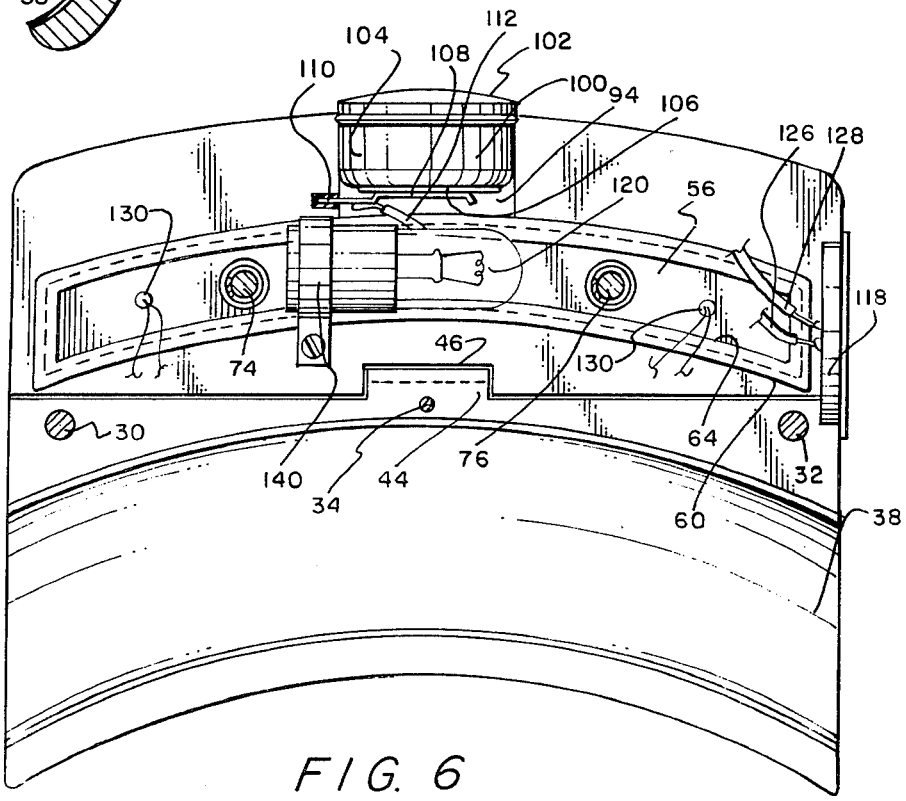
FIG. 6 is a sectional view taken upon the plane of the section line 6—6 in FIG. 5 with the visual and audio alarm devices as well as the battery being shown in elevation.

The lamp 120, which is centrally mounted in the cavity 49 by means inclusive of a strap 140, is of much greater wattage than the lamps 130 and though not of such candlepower as to blind the driver, it is bright enough to command or definitely attract the attention of the driver and his passengers if their eyes are open, and this is especially true during the hours of darkness when the highest incidence rate of dozing drivers occurs. The effect of the light 120 is augmented by the loud sound, preferably a raucous or irritating and unpleasant sound, produced by the sounder 118 which is mounted at one end of the body 22 as shown in FIGS. 3 and 6. The alarm signal emitted by the sounder 118 is as effective during daylight hours as during the night.

In use, the driver is required to grip his hand about the attachment 20 (as though it is a part of the steering wheel) with the grip being applied at such a position and with sufficient force to depress both of the push buttons 54 and 56 thereby maintaining both of the switches 80 and 82 open. Should the driver relax his attention and hand grip enough to allow either one or both of the switches 80 and 82 to close under the action of the springs 66 and 68, the sounder 118 and the lamp 120 are both energized (assuming the switch 114 to be closed) so that both the driver and his passengers are subjected to effective alarm signals indicating the driver's inability to maintain a degree of mental concentration and attentiveness sufficient to maintain a grip closing both of the switches 80 and 82.

The glow or indicator lamps 130 serve not only as a battery condition indicator but more importantly as a means whereby wary passengers can assure themselves that the driver has not elected to disable the system by opening the switch 114; it being a lamentable fact that many dozing drivers overestimate their ability to seek to avoid producing, in their warped judgment, unnecessary alarm signals.

An even stricter alarm system may include the mounting of an additional attachment 20 upon the steering wheel rim 14, say, at a ten-o'clock position, not shown. Provision of two attachments 20 can require a driver to keep two gripping hands in position, or allow him to use first one and then the other in order to relieve fatigue.

While the attachment 20 serves the immediate need for equipping extant automobiles with a dozing driver alarm system, the principles of the invention can be readily applied to automobiles yet to be produced. An indication as to how such might be readily accomplished in the light of the foregoing may be obtained on reference to FIG. 9.

Figure 9:
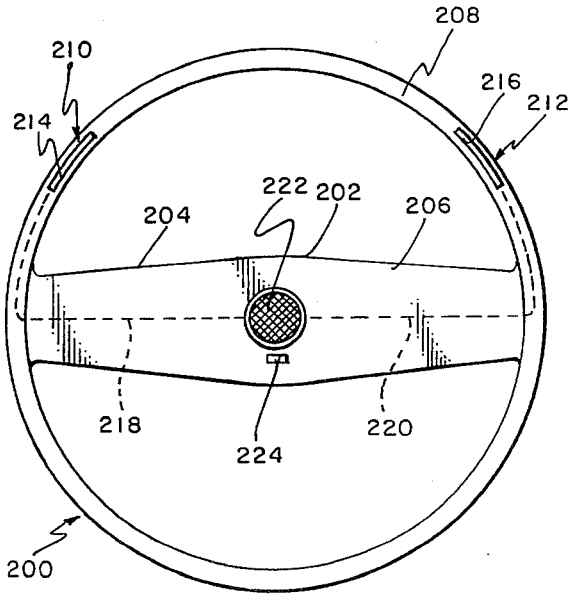
FIG. 9 illustrates a modified form of the invention such that the signaling devices as well as the push button switches are incorporated as integral components of a steering wheel.

FIG. 9 discloses a steering wheel 200 that includes a central or hub portion 202 that is connected by radially extending spokes 204 and 206 to a circular and hollow rim 208 as shown.

A pair of combination push button switches and luminous lamp units 210 and 212 are mounted on and within the rim 208. The translucent push buttons 214 and 216 of the combinations 210 and 212 normally protrude above the general external contour of the rim when the switches thereof are closed, with such switches being opened when the rim 208 is hand gripped at the positions of the combinations 210 and 212. The combinations 210 and 212 are electrically connected by means indicated at 218 and 220 to an electric sounder 222 mounted at the center of the hub 202.

An enabling electric switch 224 is also mounted on the steering wheel hub 202 and the same is connected by means not shown to control the supply of electrical energy to the combinations 210 and 212 and the sounder 222. Electrical energy is supplied to the switch 224 by connection to the ignition switch not shown of the automobile, whereby the alarm system of FIG. 9 is activated solely when both the ignition switch and the enabling switch 224 are turned on.

It will be understood that each of the combinations 210 and 212 include a main or relatively bright lamp corresponding in purpose and function to the lamp 120, as well as low wattage indicator lamps that correspond in purpose and function to the previously described lamps 130.

If the ignition switch is on and the switch 224 closed, the bright lamps of both the combinations 210 and 212 as well as the sounder 222 will be energized unless both of the combinations 210 and 212 are firmly hand gripped by the driver.

Optionally, means may be provided to disable one or the other of the combinations 210 and 212 so as to allow the driver a brief respite as to gripping both so as to relieve fatigue.

Having now fully explained the invention as to its purpose, its construction and its use, it will be evident that the same is susceptible to numerous variations without departing from the spirit thereof, and accordingly, attention is now directed to the appended claims to ascertain the actual scope of the same.

I claim:

1. A driver alarm system for a vehicle having a steering wheel rim, said system comprising:

a hand-grippable body;

means for attaching said body to the steering wheel rim at a location to be gripped by the hand of the driver applied to the rim for normal steering of the vehicle;

a pair of push buttons on said body projecting therefrom in generally opposite directions at locations to be depressed when said body is gripped by the hand of the driver of the vehicle for steering;

means for urging each push button to an extended position, said urging means yielding to permit movement of each push button to a depressed position when said body is gripped by the hand of the driver of the vehicle;

a normally completed electric circuit having a completed condition when either push button is in the extended position and an interrupted condition only when both push buttons are in the depressed condition; and an alarm signalling device in said circuit energized to produce an alarm signal when said circuit is in the completed condition, whereby the alarm signal is produced whenever the driver of the vehicle fails to grip said body sufficiently to maintain both push buttons in the depressed condition.

2. The system of claim 1, wherein said attaching means comprises a clamp on said body having a C-shaped configuration for application to the steering wheel rim to attach said body thereto by clamping action.

3. The system of claim 1, wherein said alarm signalling device includes an alarm light and an audible alarm included in said circuit and arranged in parallel with one another for energization of said alarm light and audible alarm when said circuit is in the completed condition.

4. The system of claim 3, wherein said circuit includes:

a manually operated switch having an open position in which said circuit is interrupted regardless of the status of the push buttons and a closed position in which said circuit is completed when either push button is in the extended position, whereby said alarm signalling device is disabled in the open position of said switch and enabled in the closed position of said switch; and a status light having a lesser intensity than said alarm light and a location visible to passengers in the vehicle, said status light being energized in the closed position of said switch to indicate to passengers that the alarm signalling device is enabled and deenergized in the open position of said switch to indicate to passengers that the alarm signalling device is disabled.

* * * * *